US005220141A

United States Patent [19]

Quick et al.

[11] Patent Number: 5,220,141

[45] Date of Patent: Jun. 15, 1993

[54] TREATMENT OF PAPERBOARD WITH POLAR ORGANIC COMPOUNDS TO PROVIDE MICROWAVE INTERACTIVE STOCK

[75] Inventors: James R. Quick, Greenwood Lake, N.Y.; James W. Mitchell, Sewell, N.J.

[73] Assignee: International Paper Company, Purchase, N.Y.

[21] Appl. No.: 675,205

[22] Filed: Mar. 26, 1991

[51] Int. Cl.[5] ..... H05B 6/64

[52] U.S. Cl. ..... 219/10.55 E; 219/10.55 F; 219/10.55 M; 426/234; 426/243

[58] Field of Search ..... 219/10.55 M, 10.55 E, 219/10.55 F; 427/382, 54.1; 426/107, 234, 243

[56] References Cited

U.S. PATENT DOCUMENTS

| | | | |
|---|---|---|---|
| 2,582,174 | 1/1952 | Spencer | 99/221 |
| 3,220,850 | 11/1965 | Kirk | 99/90 |
| 3,256,101 | 6/1966 | Arns | 219/10.55 E |
| 3,854,023 | 12/1974 | Levinson | 219/10.55 |
| 3,985,991 | 10/1976 | Levinson | 219/10.55 E |
| 4,252,832 | 2/1981 | Moody | 426/241 |
| 4,283,427 | 8/1981 | Winters et al. | 426/106 |
| 4,316,070 | 2/1982 | Prosise et al. | 219/10.55 E |
| 4,518,618 | 5/1985 | Hsia et al. | 426/262 |
| 4,795,649 | 1/1989 | Kearns et al. | 426/243 |
| 4,864,089 | 9/1989 | Tighe et al. | 426/107 |
| 4,933,193 | 6/1990 | Fisher | 219/10.55 E |
| 4,937,412 | 6/1990 | Dobry | 219/10.55 M |
| 4,960,614 | 10/1990 | Durand | 427/54.1 |
| 4,985,606 | 1/1991 | Fuller | 219/10.55 E |
| 5,021,293 | 7/1991 | Huang et al. | 428/328 |
| 5,053,236 | 10/1991 | Parliment et al. | 426/107 |

*Primary Examiner*—Bruce A. Reynolds
*Assistant Examiner*—Tuan Vinh To
*Attorney, Agent, or Firm*—Ostrager, Chong & Flaherty

[57] ABSTRACT

A microwave susceptor material which comprises a substrate such as paper or paperboard treated with a polar organic compound having microwave interactive characteristics. A salt, which is soluble in the polar organic compound, can be added to alter the microwave heating performance of the material. The invention provides susceptor materials useful for cooking food items in a microwave oven with enhancement of the quality of the cooked food, such as the browning and crisping of the food surface. The susceptor materials are formed by treatment of the substrates with the polar organic compounds under conditions that cause the polar organic compounds to penetrate the substrate.

17 Claims, 9 Drawing Sheets

MICROWAVE HEATING TESTS FOR EXAMPLE I

MICROWAVE HEATING TESTS FOR EXAMPLE II

TREATMENT COMPOSITION – 100% GLYCEROL

ADD-ON LEVEL – 0.4 gm. per sq. in.

MICROWAVE HEATING TESTS
FOR EXAMPLE III

MICROWAVE HEATING TESTS
FOR EXAMPLE IV

MICROWAVE HEATING TESTS FOR EXAMPLE V

MICROWAVE HEATING TESTS
FOR EXAMPLE VI
TREATMENT COMPOSITION – FORMAMIDE/SODIUM CHLORIDE
ADD-ON LEVEL – 0.18 gm per sq. in.
SAMPLE TEMPERATURE (°F)
0
100
200
300
400
500
TIME IN MICROWAVE OVEN (MINUTES)
0
1
2
3
4
5

MICROWAVE HEATING TESTS
FOR EXAMPLE VII

MICROWAVE HEATING TESTS
FOR EXAMPLE VIII
THREE-STEP COATING PROCESS WITH
SATURATED GLYCEROL/SALT MIXTURE
TOTAL ADD-ON LEVEL – 0.14 gm. per sq. in.
SAMPLE TEMPERATURE (°F)
0
100
200
300
400
500
TIME IN MICROWAVE OVEN (MINUTES)
0
1
2
3
4
5

TREATMENT OF PAPERBOARD WITH POLAR ORGANIC COMPOUNDS TO PROVIDE MICROWAVE INTERACTIVE STOCK

FIELD OF INVENTION

This invention generally relates to microwave susceptor materials useful in microwave cooking and packaging of food items. More particularly, it concerns susceptor materials which include coatings of microwave interactive polar organic compounds and methods for their production.

BACKGROUND ART

Conventional high frequency microwave ovens impart surface temperatures to foods of approximately 200° F. which are insufficient to brown and crisp food products. Cooking temperatures in conventional convection and radiant ovens of 250°-500° F. are required for effective browning and crisping of foods. To simulate convection and radiant heat sources in microwave cooking, the food packaging industry has employed microwave susceptor materials which impart high temperature levels to food surfaces in the presence of microwave energy. Such susceptor materials have found wide application in providing disposable ovenable food containers made of paper and paperboard.

Conventional susceptor materials are fabricated by depositing a film of conductive elemental metal on a non-interactive or microwave transparent supporting substrate. Microwave energy interacts with the conductive metal coating to generate heat and provide a susceptor feature. However, conventional metalized films are not entirely satisfactory in that they require use of adhesives in the fabrication of the packaging. Such adhesives emit volatile chemicals in microwave applications and present health hazards. Thus adhesives require additional processing and safety specifications to meet FDA safety requirements.

As an alternative to conventional metalized films it has been proposed that microwave susceptor characteristics may be provided through use of chemical receptors. U.S. Pat. No. 4,283,427 to Winters et al. discloses microwave packaging materials which have a chemical susceptor layer comprising aqueous polar solvents, solutes including inorganic salts and heating profile monitor substances such as clay or silica.

Winters discloses microwave packaging materials in which a chemical susceptor layer is inserted within an enclosed plastic pouch. Upon heating in a microwave oven the aqueous polar solvent is vaporized leaving the solute material to heat to its maximum temperature to cook the food item. Heat profile monitors, are employed to control the rate at which the solvent vaporizes and the resultant temperature of the susceptor material. However, this approach is not entirely satisfactory in microwave applications in that the holder for the chemical susceptor must provide a means for escape of the solvent upon heating. If the solvent is not vented from the enclosed system, continuous heating of the food item occurs.

Further, attempts in the art to utilize chemical susceptors in microwave applications have been limited to coatings prepared and placed directly upon the food items to be cooked. See U.S. Pat. No. 4,518,618 to Hsia et al. and U.S. Pat. No. 4,252,832 to Moody.

Chemical susceptors comprising polar organic compounds have not, heretofore, been utilized in microwave food packaging materials. This invention is directed to the preparation of packaging materials which incorporate such polar organic compounds to provide desired thermal heating effects for food during microwave cooking. It will be appreciated that advantage would be obtained by providing such an alternative to metallic conductor or semi-conductor films as microwave susceptor materials.

Accordingly, it is a broad object of the invention to provide microwave susceptor materials which utilize polar organic compounds, having microwave interactive characteristics, coated or saturated on a substrate.

A more specific object of the invention is to provide a method which enhances the microwave interactivity of polar organic compounds through the addition of salts.

Another object of the invention is to provide low cost, flexible food packaging which can be used in microwave cooking that incorporates polar organic compounds imbided in various substrates.

A specific object of the invention is to provide microwave paper-like food packaging in which the type and relative amounts of polar organic compounds and salts may be varied to accommodate specific heat profile requirements of food products.

DISCLOSURE OF INVENTION

In the present invention, these purposes, as well as others which will be apparent, are achieved generally by treating substrates with liquid compositions comprised of polar organic compounds having microwave interactive characteristics. Salts are added in some cases to enhance the microwave heating characteristics of the polar organic compounds. Substrates employed in the invention include paper, paperboard and polyester coated paperboard.

Microwave susceptors of the invention are produced by a method of contacting the surface of a substrate with a liquid composition comprising a polar organic compound having microwave interactive characteristics. The liquid composition penetrates the substrate to form the microwave susceptor material.

A preferred set of process parameters of the invention involve heating the liquid composition to temperatures in the range of 145° F. to 500° F. and contacting the substrate with the liquid composition for 15 to 60 seconds to attain add-on levels to the substrate between 0.04 and 0.38 grams per square inch.

In a preferred embodiment of the invention the liquid composition comprises both a polar organic compound and a salt, which may be present in an amount in excess of that required to saturate the polar organic compound at the temperature at which the liquid composition is applied to the substrate. The salt enhances the microwave heating characteristics of the polar organic compound.

Preferred polar organic compounds employed in the invention include polyols which may be provided in liquid or solid form, such as glycerol or sorbitol or a combination thereof. Other suitable polar organic compounds include high-boiling liquids such as formamide.

Salts employed in the invention may be selected from the group consisting of inorganic salts and carboxylic acid salts. Preferred salts of the invention include sodium chloride, sodium carbonate or potassium acetate.

In accordance with an alternative method, the substrate is first contacted with a salt/water liquid mixture, preferably of sodium chloride and water maintained at a temperature of about 200° F., for sufficient duration to allow penetration of the salt/water mixture into the substrate. Following drying of the salt/water treatment the substrate surface is contacted with a heated polar organic compound or a heated mixture of a polar organic compound and a salt to form a microwave susceptor of the invention.

In another alternative method of the invention, a microwave susceptor is prepared by first contacting the surface of the substrate with a liquid mixture of salt, water and isopropyl alcohol, maintained at room temperature. The liquid mixture penetrates the substrate surface and is allowed to dry. The presence of the isopropyl alcohol enhances the penetration of the mixture into the substrate. The substrate surface is then contacted with a liquid composition, preferably comprised of glycerol and isopropyl alcohol, maintained at room temperature, and then dried to form a microwave susceptor.

The liquid composition can be contacted to the surface of the substrate by a variety of methods including dipping, coating and printing methods.

Preferred applications of the materials of the invention include use in microwave food packaging. As used in these applications, the materials of invention may be coated, by either extrusion or film lamination processes, with a polymeric film to act as a food release agent or barrier between the microwave susceptor material and food product. Advantageously, the treatment of a substrate with polar organic compounds provides microwave susceptor materials that are less complex to manufacture than metallic conductor or semi-conductor films. Further advantage is obtained by adjusting the types and relative amounts of the polar organic compounds and salts to accommodate specific heat profile requirements of food products.

Other objects, features and advantages of the present invention will be apparent when the detailed description of the preferred embodiments of the invention are considered in conjunction with the drawings, which should be construed in an illustrative and not limiting sense as follows:

DETAILED DESCRIPTION OF THE PREFERRED EMBODIMENT

In accordance with the invention, microwave susceptor materials are provided by treating a substrate with polar organic compounds having microwave interactive characteristics, which may be modified by the addition of salts to provide improved microwave heating characteristics. The substrate material comprises paper, paperboard or polyester coated paperboard. A microwave susceptor composite may be formed by the single step process of contacting the substrate with the polar organic compound in liquid form, either with or without added salt, and allowing the liquid composition to penetrate the substrate.

Figure 1:
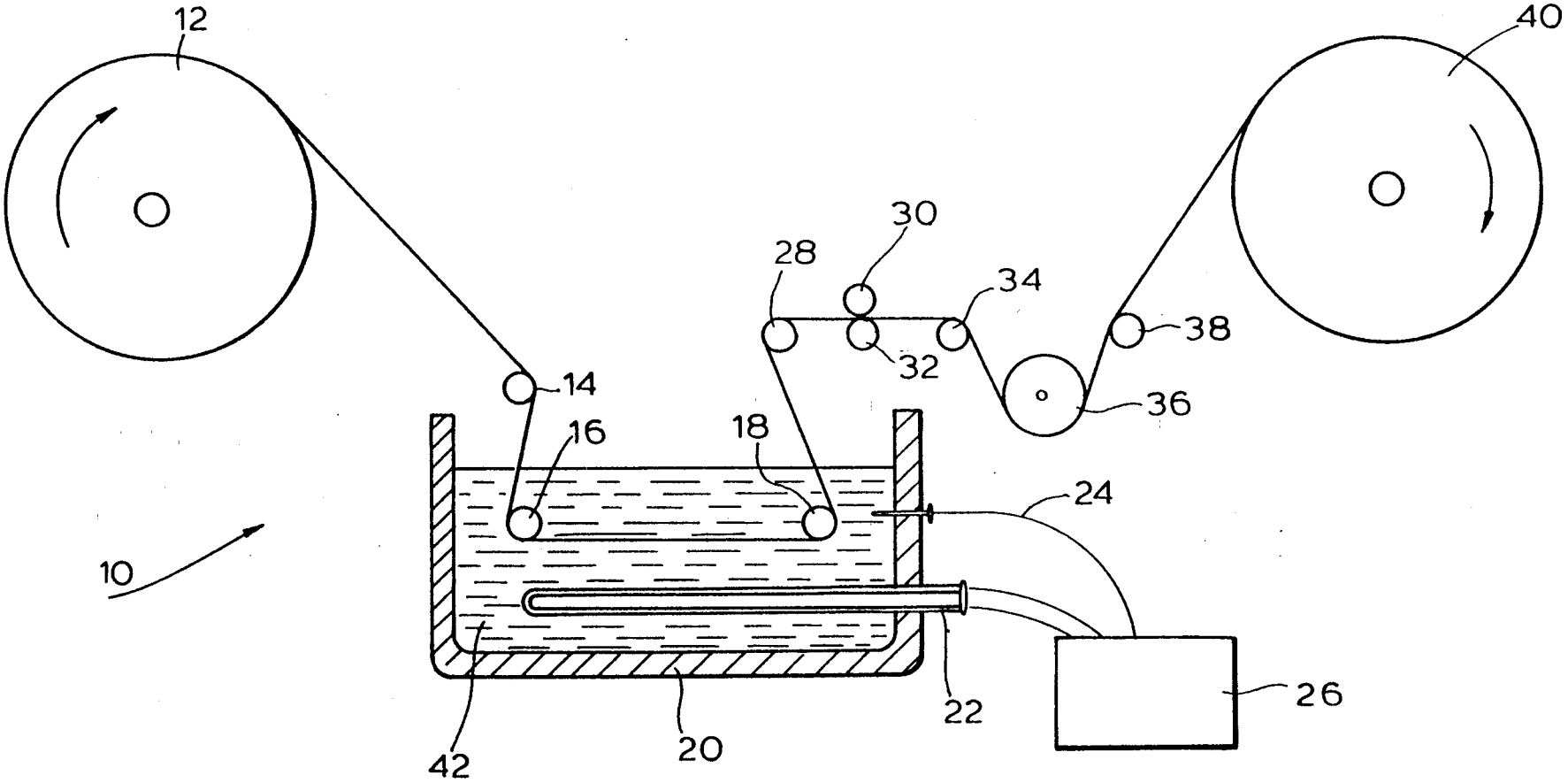
FIG. 1 is a schematic view of an apparatus for treating paperboard with polar organic compounds.

FIG. 1 is a schematic view of an apparatus 10, employed for preparation of the microwave susceptor materials of the invention process. In general, the substrate is passed through a tank, 20 containing a liquid composition 42. The substrate is removed from tank 20, and passed through additional rollers 30 and 32 to remove excess liquid to form the microwave susceptor material.

As shown in this illustration, the untreated substrate is wound on roll 12. The untreated substrate is passed along from roll 12 and immersed in the liquid composition 42 moving through rollers 14 16 and 18. The temperature of the liquid composition in tank 20 is maintained within the range of 145° F. to 500° F., by an electric heater 22, which is controlled by a heater control unit 26. A temperature sensor 24 is contained within the liquid composition 42 to monitor the temperature. The higher the temperature the greater the degree of penetration of the liquid composition into the substrate.

Under preferred conditions, as illustrated in FIG. 1, the substrate is immersed in the liquid composition 42 between 15 and 60 seconds for optimum penetration of the liquid into the substrate. Under these conditions the substrate becomes impregnated with the liquid composition throughout the entire substrate. Preferred add-on levels to the substrate of the liquid composition are between 0.04 and 0.38 grams per square inch. The resulting microwave susceptor material can be further processed into microwave packaging for cooking applications.

Preferred substrates employed in the invention include uncoated bleached paperboard, referred to as solid bleached sulfate ("SBS"), and the same basestock with a polyester coating applied by a conventional extrusion coating process. In either case a preferred weight of the paperboard is 215 lb. per 3000 sq.ft. A preferred polyester coating weight is 25 lb. per 3000 sq.ft. Both the uncoated and polyester coated SBS stocks are available from International Paper in Memphis, Tenn.

Preferred liquid compositions employed in the invention may be comprised entirely or partially of polar organic compounds such as polyols, which may be provided in liquid or solid form, such as glycerol or sorbitol. Other polyols and mixtures of different polyols may also be used. Generally polyols with boiling points above 300° F. will be preferred for the preparation of microwave susceptor materials intended to provide browning and crisping effects. Glycerol is a preferred liquid polyol because of its microwave interactivity, high boiling point (554° F.) and nontoxicity in cooking applications. When solid polyols, such as sorbitol, are used, they must either have melting points sufficiently low to permit their application to the substrate in a liquified state, or they must be used in combination with a lower melting polar organic compound, such as glycerol, to provide a liquid composition at the temperature of application. Other alternative polar organic compounds used include high-boiling, highly polar organic liquids, such as formamide.

In some embodiments of the invention, the liquid composition 42, further comprises between a salt in tank 20. The salt enhances the microwave heating characteristics of the polar organic compound. The amount of salt added may be in excess of the amount required to saturate the polar organic compound at the temperature of application, or the salt may be totally dissolved in the polar organic compound. Salts employed in the invention are soluble in the polar organic compound and may be selected from the group consisting of inorganic salts and carboxylic acid salts. Preferred salts utilized include sodium chloride, potassium acetate and sodium carbonate.

An alternative method for preparing a microwave susceptor of the invention includes the first step of contacting the surface of the substrate with a mixture of water and a salt, preferably sodium chloride present in an amount sufficient to saturate the water at the temperature of application, about 200° F. The salt/water mixture penetrates the substrate and is allowed to dry. The substrate surface is then contacted with the liquid composition, 42, as in the process line outlined in FIG. 1, to form a microwave susceptor of the invention. The liquid composition, 42, preferably is comprised of a mixture of a polar organic compound and an inorganic or carboxylic acid salt, maintained at an elevated temperature. A preferred liquid composition is comprised of glycerol and sodium chloride, with the amount of sodium chloride being sufficient to saturate the glycerol at the temperature of application.

In another alternate method of the invention a microwave susceptor of the invention is prepared by first contacting the surface of the substrate with a liquid mixture of salt, water and isopropyl alcohol, maintained at room temperature. A preferred liquid mixture comprises 21.5 wt. % sodium chloride, 71.5 wt. % water, and 7 wt. % isopropyl alcohol. The liquid mixture penetrates the substrate surface and is allowed to dry. The presence of isopropyl alcohol enhances the penetration of the liquid mixture into the substrate. The substrate surface is then contacted with a liquid composition 42, as in the process line as outlined in FIG. 1, and then dried to form a microwave susceptor of the invention. In this method, the liquid composition, 42, preferably is comprised of 75 wt. % glycerol and 25 wt % isopropyl, maintained at room temperature.

Examples I to X presented below, illustrate alternative embodiments of the invention wherein paperboard is treated with various polar organic compounds both with and without added salts. These examples, however, are representative and not considered to be inclusive of all the possible embodiments of the invention.

Examples I through V, and X utilize a single step process to treat paperboard with heated polyols, or polyol/salt mixtures; Example VI provides paperboard treated with formamide and sodium chloride in a single treatment step; Examples VII and IX employ two-step treatment processes for treating paperboard with glycerol and sodium chloride; and in Example VIII paperboard is treated with a glycerol/salt mixture by a multistep coating process.

The paperboard used in Examples I to VII and IX, was uncoated bleached paperboard of the type commonly referred to as solid bleached sulfate ("SBS"), weighing about 215 pounds per 3000 sq ft. In both Examples VIII and X, the paperboard used was SBS with a polyester extrusion coating on one side, with a polyester coating weight of 25 lb. per 3000 sq.ft.

The single step treatments were accomplished by dipping preweighed pieces of paperboard into heated polyols, or polyol/salt mixtures for 15–60 seconds. The paperboard samples were then weighed to determine the amount of material added and the treatment level was calculated in gm per sq. in. The treatments were applied to paperboard samples at various temperatures over the range of 145° F. to 500° F., resulting in add-on levels ranging from 0.04 to 0.38 gm per sq in. The microwave heating characteristics of each of these samples was determined by measuring the surface temperature of the sample as it was heated in a standard domestic 700 watt microwave oven (J.C. Penny Model 5985). The temperature measurements were made with a Luxtron Model 750 fiber optic thermometer, (Luxtron, 1060 Terra Bella Avenue, Mountain View, Calif. 94043), with the fiber optic probe placed through a small hole in the oven housing and held in place on the sample surface during the test with a small piece of heat-resistant tape. Generally, a material must reach a temperature of at least 300° F. to perform the function of browning and crisping foods during microwave cooking. Both the maximum temperature reached in a 5 minute microwave heating test and the time required to reach a temperature of 300° F. are considered to be valid indicators of the utility of a material in microwave browning and crisping applications.

EXAMPLE I

Figure 2:
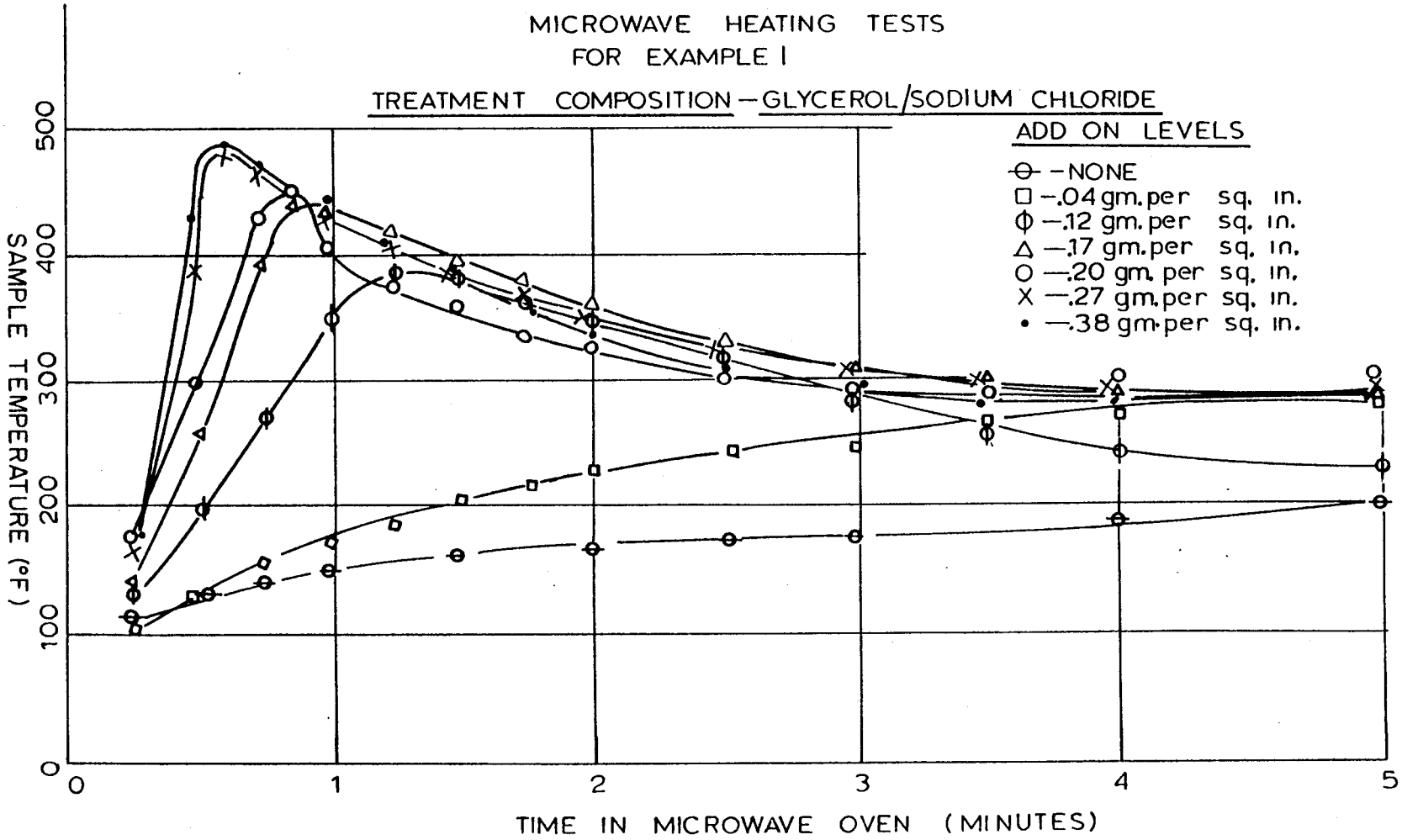
FIG. 2 is a graph of the heating profiles of treated paperboard, in accordance with Example I.

Uncoated SBS paperboard was treated with hot mixtures of glycerol and sodium chloride (NaCl) at various temperatures from 150° F. to 300° F. The mixtures of glycerol and sodium chloride all contained 67% glycerol and 33% sodium chloride. The amount of sodium chloride used was in excess of that required to saturate the glycerol at all treatment temperatures. Treatment temperatures, add-on levels and microwave heating test results are graphically illustrated in FIG. 2 and presented in Table I. For comparison with these microwave heating test results, a piece of plain paperboard, tested in the same manner, reached a maximum temperature of only 200° F. in a 5 minute test in the same microwave oven.

TABLE I

MICROWAVE HEATING TEST RESULTS OF EXAMPLE I

| Composition of Treatment Mixture | Treatment Temp. (°F.) | Add-On Level (gm/sq in) | Maximum Temp. (°F.) in 5 min test | Time to Reach 300° F. (sec.) |
|---|---|---|---|---|
| 67% glycerol 33% NaCl | 150 | 0.04 | 280 | — |
| 67% glycerol 33% NaCl | 185 | 0.12 | 385 | 51 |
| 67% glycerol 33% NaCl | 200 | 0.17 | 440 | 35 |
| 67% glycerol 33% NaCl | 225 | 0.20 | 450 | 30 |
| 67% glycerol 33% NaCl | 250 | 0.27 | 480 | 25 |
| 67% glycerol 33% NaCl | 300 | 0.38 | 490 | 23 |

EXAMPLE II

In this case the uncoated SBS paperboard was treated with hot glycerol only, without the addition of any salt.

Figure 3:
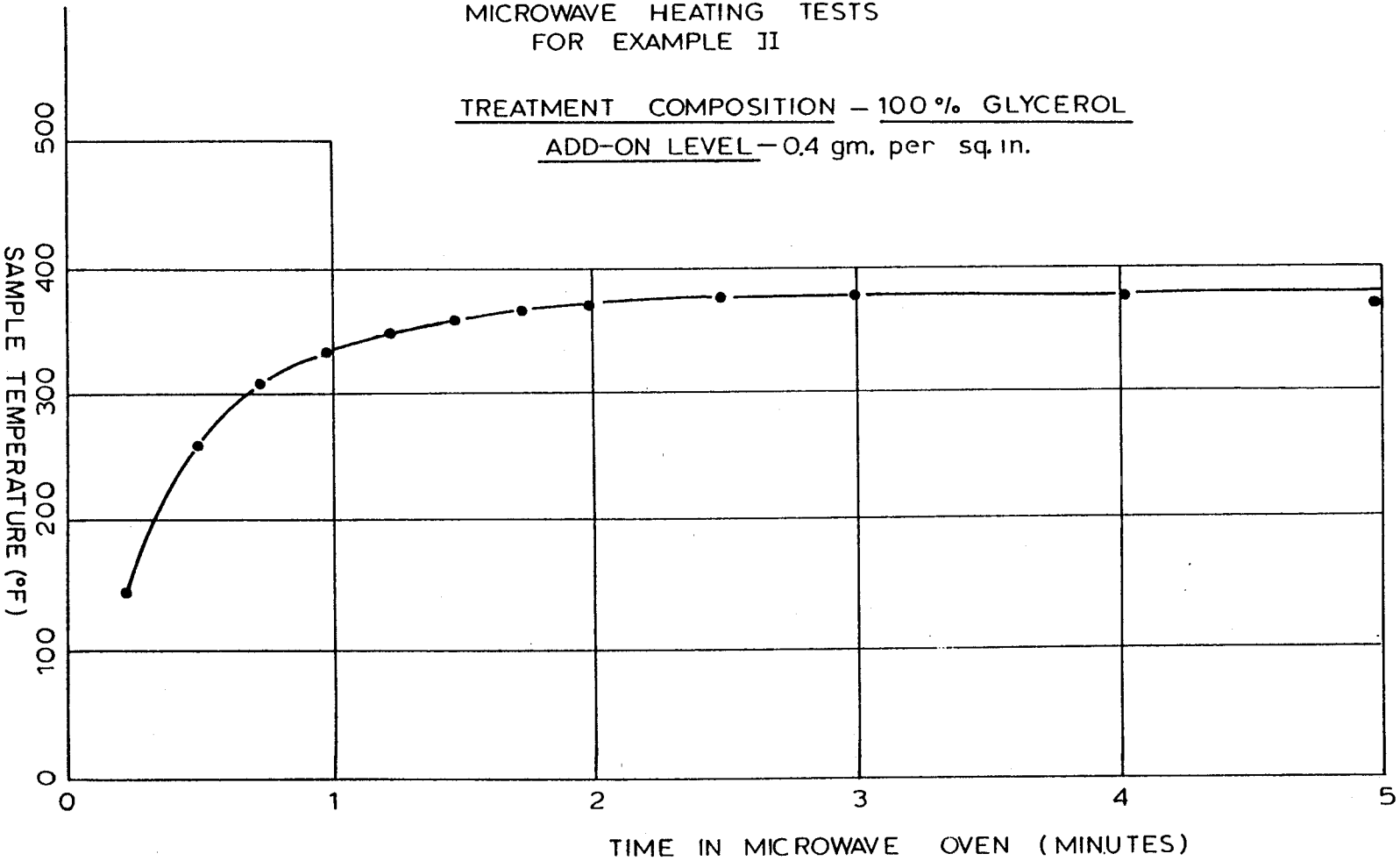
FIG. 3 is a graph of the heating profiles of treated paperboard, in accordance with Example II.

Treatment temperature was 400° F., the time of treatment was 15–30 seconds, and the add-on level was 0.4 gm per sq. in. As shown in FIG. 3, this sample reached a temperature of 300° F. in 42 seconds, and had a maximum temperature of 375° F. at the end of the 5 minute test.

EXAMPLE III

Figure 4:
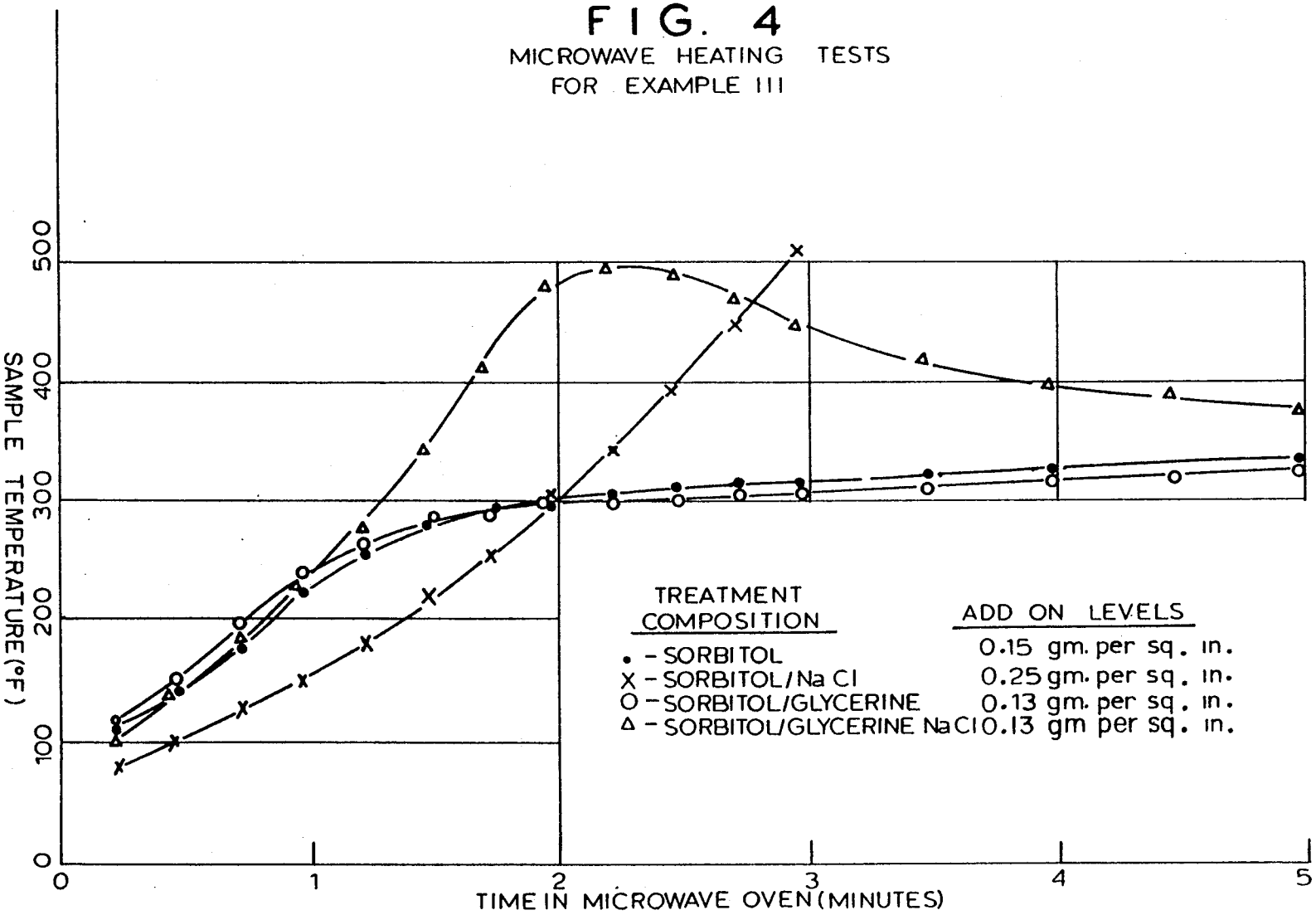
FIG. 4 is a graph of the heating profiles of treated paperboard, in accordance with Example III.

Test samples were prepared from uncoated SBS paperboard treated with sorbitol, both with and without the addition of salt; a sample treated with a mixture of sorbitol and glycerol; and a sample treated with a three component mixture of sorbitol, glycerol and salt were prepared. In this example, the salt was sodium chloride, as in Example I. The compositions of the treatment mixtures, treatment temperatures, add-on levels and the results of the microwave heating tests are graphically illustrated in FIG. 4 and presented in Table II.

TABLE II

MICROWAVE HEATING TEST RESULTS OF EXAMPLE III

| Composition of Treatment Mixture | Treatment Temp. (°F.) | Add-On Level (gm/sq in) | Maximum Temp. (°F.) in 5 min test | Time to Reach 300° F. (sec.) |
|---|---|---|---|---|
| 100% sorbitol | 500 | 0.15 | 325 | 135 |
| 67% sorbitol 33% NaCl | 500 | 0.25 | >500 | 120 |
| 83% sorbitol 17% glycerol | 450 | 0.13 | 315 | 165 |
| 60% sorbitol 12% glycerol 28% NaCl | 450 | 0.13 | 490 | 80 |

For the two treatment mixtures containing sodium chloride, the amount used in each case was sufficient to saturate the molten sorbitol or the sorbitol/glycerol mixture at the temperature of application.

EXAMPLE IV

Figure 5:
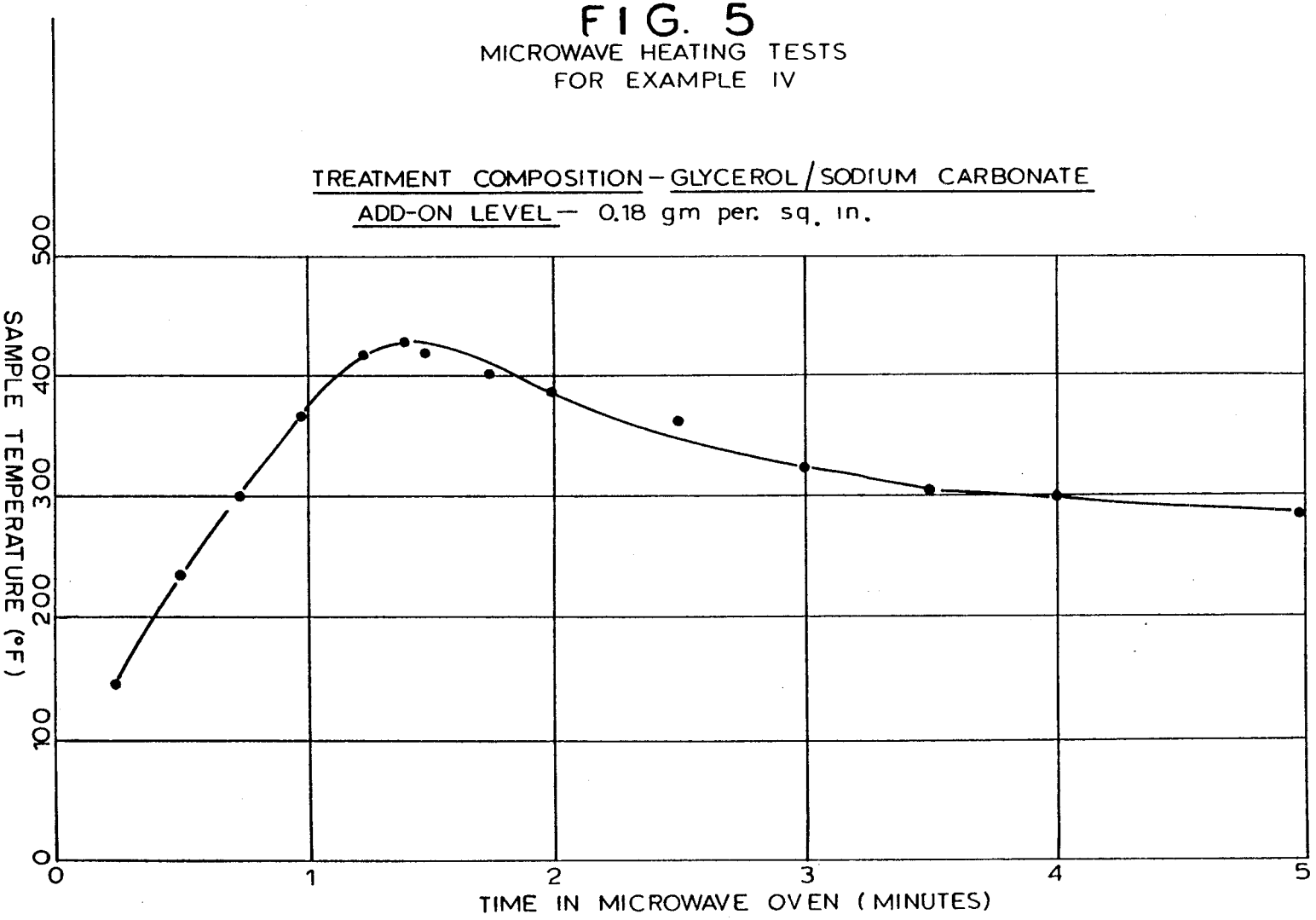
FIG. 5 is a graph of the heating profiles of treated paperboard, in accordance with Example IV.

A sample of uncoated SBS paperboard was treated with a mixture of glycerol and sodium carbonate (anhydrous $Na_2CO_3$). The treatment mixture consisted of 67% glycerol and 33% sodium carbonate, with the amount of sodium carbonate far in excess of the amount required to saturate the glycerol at the treatment temperature of 200° F. The treated sample had an add-on level of 0.18 gm. per sq.in. As shown in FIG. 5, during a 5 minute microwave heating test, this sample reached 300° F. in 45 seconds, and had a maximum temperature of 425° F. at 1 minute 25 seconds.

EXAMPLE V

Figure 6:
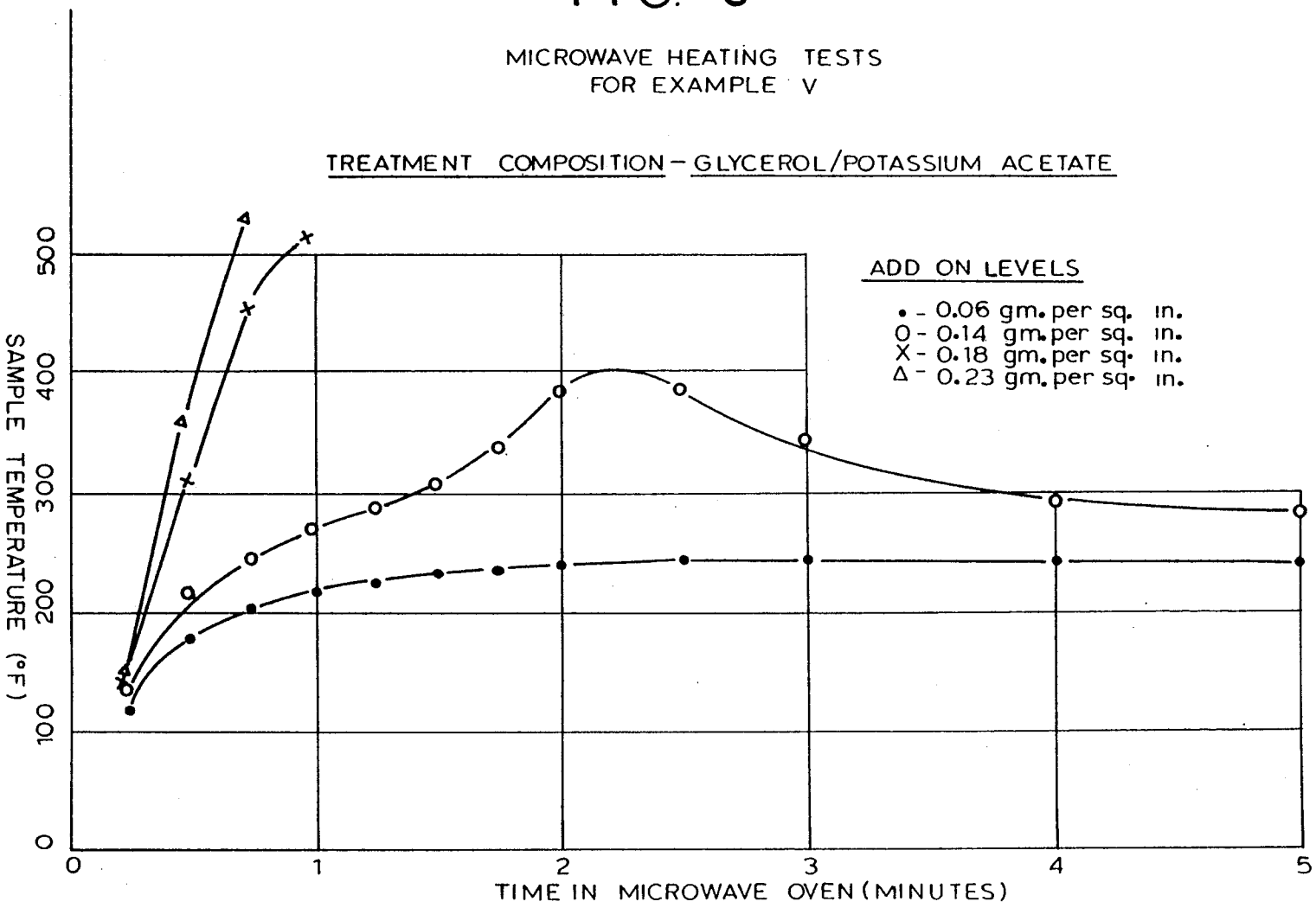
FIG. 6 is a graph of the heating profiles of treated paperboard, in accordance with Example V.

A series of samples were prepared from uncoated SBS paperboard treated with a mixture of glycerol and potassium acetate. The composition of the treatment mixture was 67% glycerol and 33% potassium acetate. The treatment was applied to paperboard samples at a range of temperatures from 145°–200° F. The potassium acetate was completely dissolved in the glycerol over the full range of treatment temperatures. Resulting add-on levels and microwave heating test results are graphically illustrated in FIG. 6 and presented in Table III.

TABLE III

MICROWAVE HEATING TEST RESULTS OF EXAMPLE V

| Composition of Treatment Mixture | Treatment Temp. (°F.) | Add-On Level (gm/sq in) | Maximum Temp. (°F.) in 5 min test | Time to Reach 300° F. (sec.) |
|---|---|---|---|---|
| 67% glycerol 33% potassium acetate | 145 | 0.06 | 240 | — |
| 67% glycerol 33% potassium acetate | 160 | 0.14 | 400 | 87 |
| 67% glycerol 33% potassium acetate | 175 | 0.18 | >500 | 30 |
| 67% glycerol 33% potassium acetate | 200 | 0.23 | >500 | 25 |

EXAMPLE VI

Figure 7:
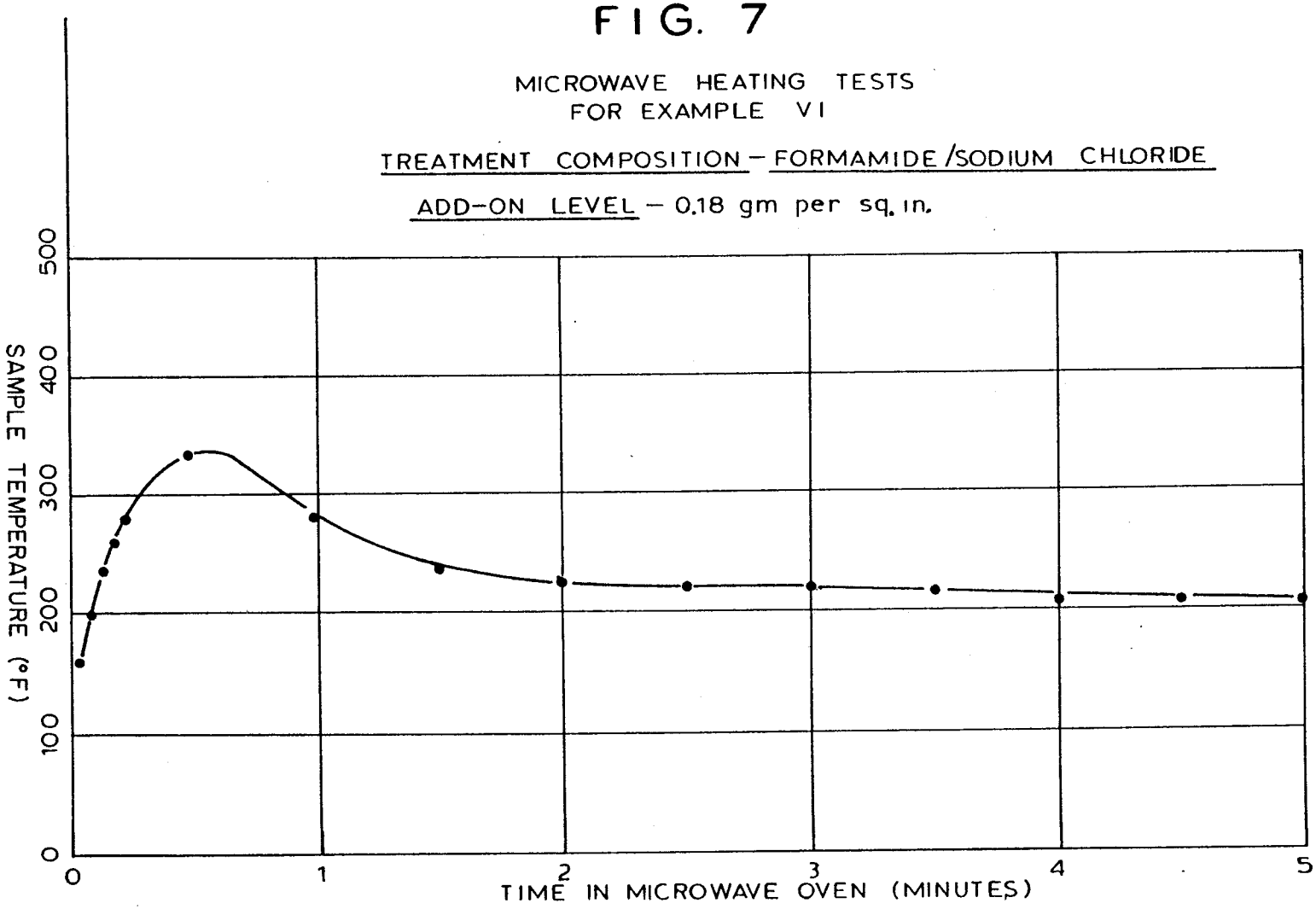
FIG. 7 is a graph of the heating profiles of treated paperboard, in accordance with Example VI.

A sample of uncoated SBS paperboard was treated with a mixture of formamide and sodium chloride. The treatment mixture consisted of 67% formamide and 33% sodium chloride. The amount of sodium chloride was in excess of the amount required to saturate the formamide at the treatment temperature of 150° F. A treatment time of 15 seconds gave an add-on level of 0.18 gm. per sq.in. In this case the microwave heating test was somewhat different than that of Examples I to V. To simulate the presence of food in the microwave oven, a glass beaker containing 100 ml of water was placed in the rear of the oven. With this modified test, as shown in FIG. 7, the paperboard sample treated with formamide and salt reached 300° F. at 18 seconds and a maximum temperature of 335° F. at 30 seconds, with a declining temperature for the balance of the 5 minute test.

EXAMPLE VII

Figure 8:
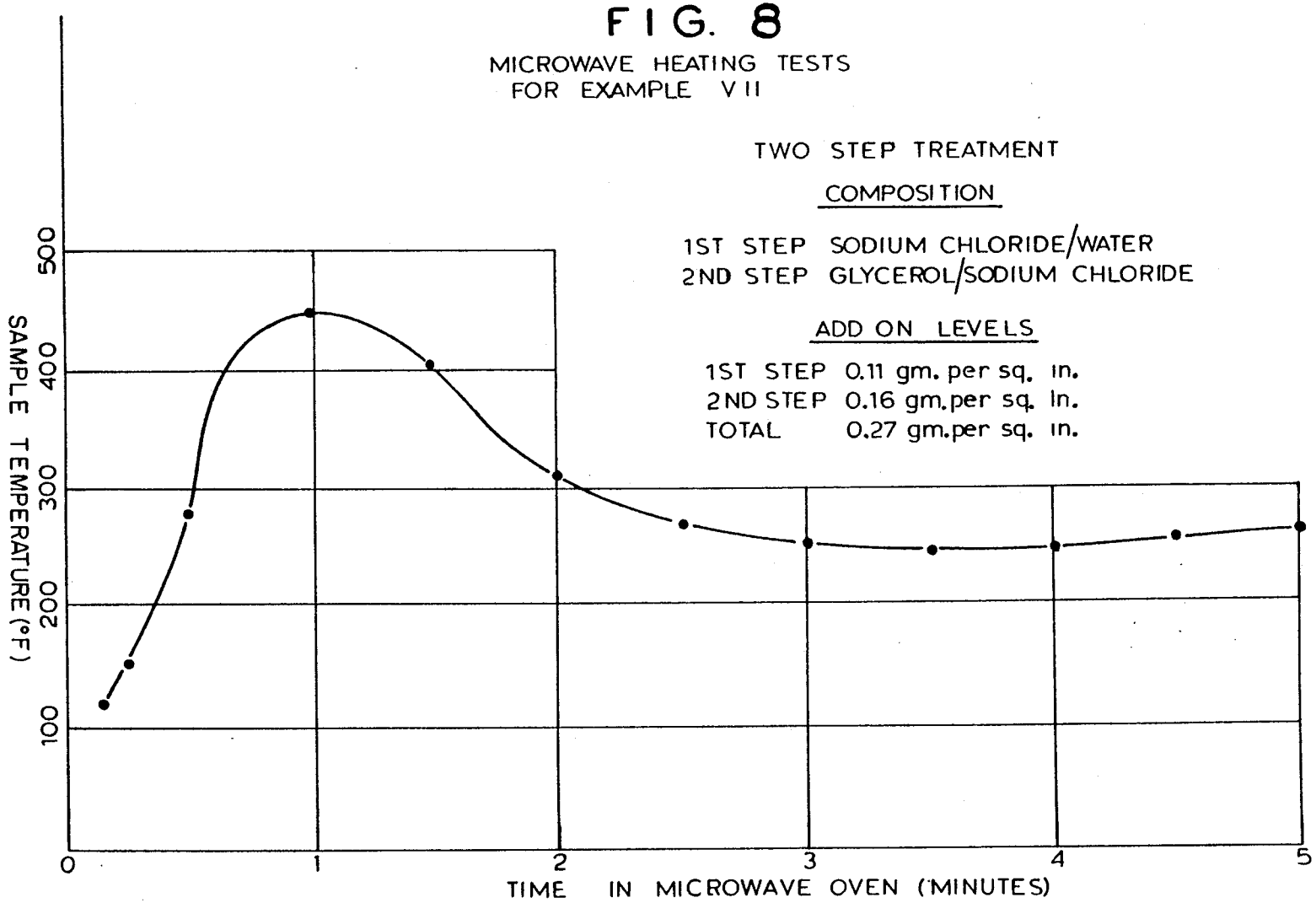
FIG. 8 is a graph of the heating profiles of treated paperboard, in accordance with Example VII.

A two step treatment process was used to produce a paperboard sample treated with glycerol and sodium chloride with an additional quantity of sodium chloride supplementing that provided by the single-step treatment of Example I. The treatment process consisted of first dipping a piece of uncoated SBS paperboard in a mixture of sodium chloride and water (50%/50%) for 20 seconds at 200° F. The sample was dried to remove the water and then dipped in a mixture of glycerol and sodium chloride (67%/33%) for 20 seconds at 225° F. The amount of salt used in each case was sufficient to produce a saturated mixture. The resulting add-on levels were 0.11 gm. per sq.in. for the first step and 0.16 gm. per sq.in. for the second step. The treated sample was tested in the same manner as the sample of Example VI. As shown in FIG. 8, after 31 seconds the sample reached a temperature of 300° F., and after about 1 minute, a maximum temperature of 450° F.

EXAMPLE VIII

Figure 9:
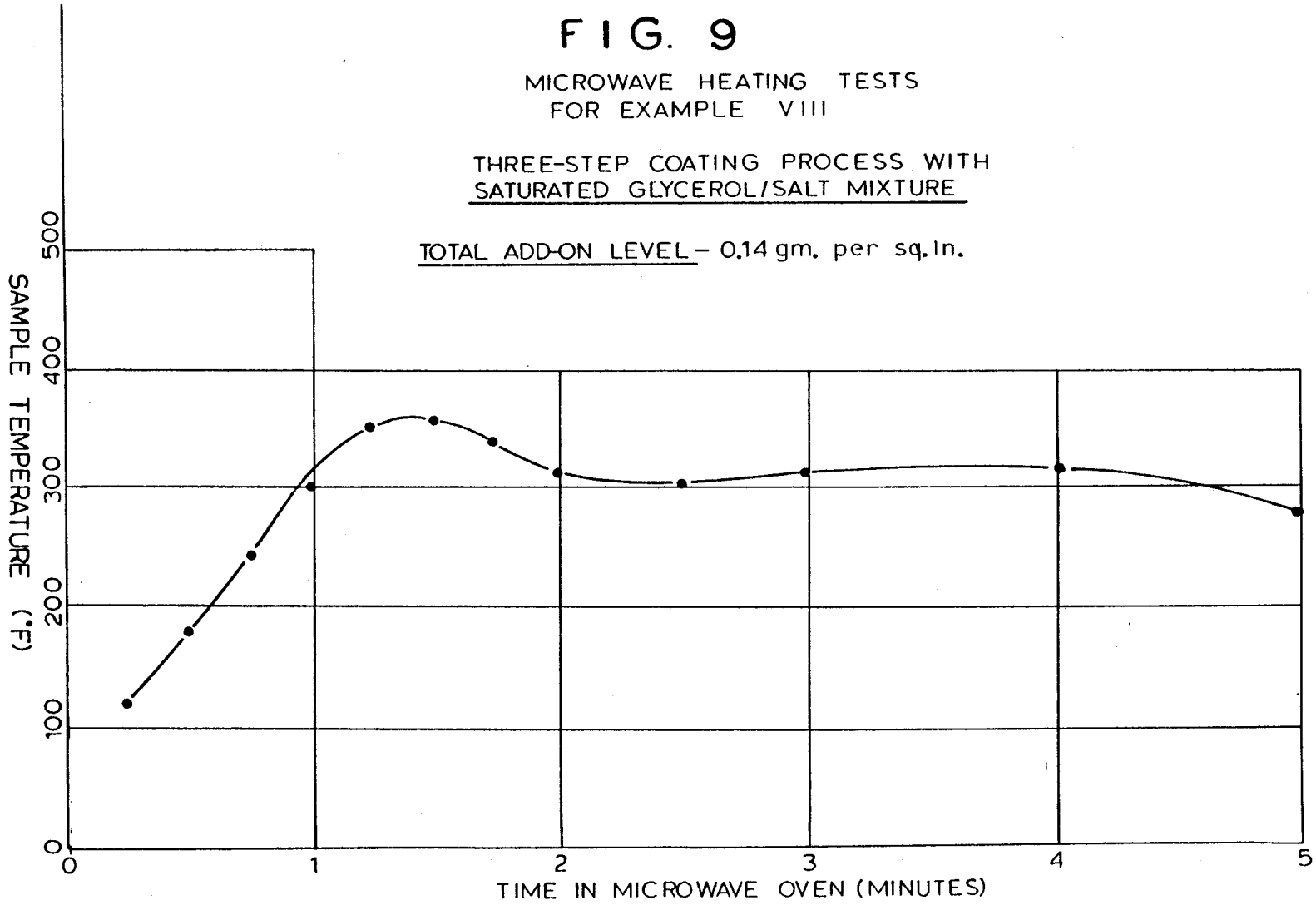
FIG. 9 is a graph of the heating profiles of treated paperboard, in accordance with Example VIII.

A coating process was used to produce samples of paperboard treated with glycerol and sodium chloride. A glycerol/salt mixture was first saturated with salt at about 250° F., then the mixture was cooled to room temperature and the saturated liquid was separated from the undissolved salt to provide the liquid composition for coating the paperboard. The paperboard used in this case was different than that used in all the preceding examples. In this case the paperboard was SBS (solid bleached sulfate) with a polyester extrusion coating on one side. The weight of the SBS board was 215 lb. per 3000 sq.ft. and the weight of the polyester extrusion coating was 25 lb. per 3000 sq ft. The method of applying the glycerol/salt mixture consisted of coating the liquid composition on the side of the paperboard opposite the polyester coating using a wire wound coating rod delivering a nominal coating thickness of about 3 mil and then placing the sample in a forced circulation oven at about 250° F. to cause the glycerol/salt coating to soak into the paperboard. The process was repeated three times, resulting in a total add-on level of 0.14 gm. per sq.in. The treated sample was tested in the same manner as the sample of Example VI, in this case with the Luxtron fiber optic probe contacting the polyester coated surface of the sample. As shown in FIG. 9, the time to reach 300° F. in a 700 watt microwave oven was 57 seconds, and the maximum temperature reached during the 5 minute test was about 360° F.

EXAMPLE IX

Uncoated SBS paperboard was treated with a mixture of sodium chloride, water and isopropyl alcohol; and then with a mixture of glycerol and isopropyl alcohol. Both treatments were done by dipping the paperboard in the specified appropriate mixture for 30 seconds at room temperature, and the sample was dried after each treatment. The composition of the first treatment mixture was 21.5% sodium chloride, 71.5% water and 7% isopropyl alcohol. The composition of the second treatment mixture was 75% glycerol and 25% isopropyl alcohol. The treated sample was tested to determine its effectiveness for the browning and crisping of food products by placing it next to a piece of untreated paperboard in a 700 watt microwave oven (J.C. Penny Model 5985), placing a cookie partially on the treated sample and partially on the untreated paperboard, and cooking for 2 min. The portion of the cookie on the treated sample was blackened, while the portion on the untreated paperboard was the original brown color of the cookie.

EXAMPLE X

Samples of paperboard of the type used in Example VIII were treated with a glycerol and sodium chloride mixture. In this case the composition of the treatment mixture was 94% glycerol and 6% sodium chloride. The amount of sodium chloride used was sufficient to saturate the glycerol at the treatment temperature of 250° F. Two samples, each 8 inches×8 inches square were prepared by dipping the paperboard in the heated glycerol/salt mixture for 60 seconds, resulting in add-on levels of 0.13–0.14 gm per sq in. The two treated paperboard samples were place together with both polyester-coated surfaces turned outwards, so that the treated paperboard surfaces were in contact. This two-ply sample was used for a microwave pizza cooking test with a Celeste brand frozen pizza. The pizza was placed on the two-ply sample and cooked for 8 minutes in a 700 watt microwave oven (J.C. Penny Model 5985). The resulting pizza was uniformly brown and crisp over the entire bottom surface. For comparison, the same type of pizza was cooked in the same oven for 8 min on an ordinary paper plate. This control pizza was soft on the bottom with no browning and crisping.

Preferred applications of the microwave susceptor materials of the invention include use in microwave food packaging. As used in these applications, the substrate materials of the invention may be treated completely as shown in FIG. 1 by immersion into the polar organic liquid or may alternatively be coated by methods that provide for selective coverage of a portion of the substrate, such as gravure roll coating.

Advantageously, the method of this invention for producing paperboard treated with polar organic compounds is less complex than the production of microwave susceptor materials utilizing thin metallic coatings. The utilization of a relatively simple treatment process provides a low cost microwave food packaging material. Also, the types and relative amounts of the polar organic compounds and salts used in this method can be varied to accommodate specific heat profile requirements.

It will be recognized by those skilled in the art that the invention has wide application in the production of a diversity of paper or paperboard products having microwave susceptor characteristics suitable for imparting desired thermal heating effects, such as browning and crisping, to microwave food products.

Numerous modifications are possible in light of the above disclosure such as selective application of different treatment compositions to portions a substrate material to produce a microwave package having varying heat profiles. Finally, other multi-ply constructions, comprised of a greater number of plies than the sample of Example X, are possible, and may have plies of differing compositions.

Therefore, although the invention has been described with reference to certain preferred embodiments, it will be appreciated that other composite structures and processes for their fabrication may be devised, which are nevertheless within the scope and spirit of the invention as defined in the claims appended hereto.

We claim:

1. A microwave susceptor material comprising a substrate and a liquid composition, wherein said liquid composition impregnates said substrate, said liquid composition includes a polar organic compound having microwave interactive characteristics; wherein said polar organic compound is a polyol or formamide and is present between 60 to 100 weight % of said liquid composition.

2. A microwave susceptor material as defined in claim 1, wherein said polyol is a liquid at room temperature.

3. A microwave susceptor material as defined in claim 2, wherein said polyol is glycerol.

4. A microwave susceptor material as defined in claim 1, wherein said polyol is a solid at room temperature.

5. A microwave susceptor material as defined in claim 4, wherein said polyol is sorbitol.

6. A microwave susceptor material as defined in claim 1, wherein said liquid composition comprises more than one polar organic compound.

7. A microwave susceptor material as defined in claim 1, wherein said liquid composition further comprises a salt selected from the group consisting of inorganic salts and carboxylic acid salts.

8. A microwave susceptor material as defined in claim 7, wherein said salt is sodium chloride, sodium carbonate or potassium acetate.

9. A microwave susceptor material as defined in claim 7, wherein said salt is present in an amount sufficient to saturate said polar organic compound.

10. A microwave susceptor material as defined in claim 1, wherein said substrate comprises paper, paperboard, or polyester coated paperboard.

11. A microwave susceptor material as defined in claim 1, wherein the add-on levels of said liquid composition to said substrate are in the range of 0.04 to 0.38 grams per square inch.

12. A microwave susceptor material as defined in claim 1, wherein a layer of polymeric material functioning as a food contact surface is provided on one surface of said microwave susceptor material.

13. A microwave susceptor material as defined in claim 12, wherein said layer of polymeric material functioning as a food contact surface is a polyester coating.

14. A microwave susceptor material as defined in claim 1, wherein said substrate is treated with a mixture of salt and water.

15. A microwave susceptor material as defined in claim 1, wherein said substrate is treated with a mixture of salt, water and alcohol.

16. A microwave susceptor material as defined in claim 1, wherein said substrate has an exterior surface and said liquid composition is uniformly applied to said exterior surface.

17. A microwave susceptor material as defined in claim 1, wherein said substrate has an exterior surface and said liquid composition is applied to selective portions of said exterior surface.

* * * * *